US005295436A

United States Patent [19]

Kittsteiner et al.

[11] Patent Number: 5,295,436

[45] Date of Patent: Mar. 22, 1994

[54] INNER BLANKET SECUREMENT ASSEMBLY

[75] Inventors: Hans-Jürgen Kittsteiner, Ruhpolding; Kurt G. Nagler; Erich G. Wieland, both of Würzburg, all of Fed. Rep. of Germany

[73] Assignee: Koenig & Bauer Aktiengesellschaft, Wurzburg, Fed. Rep. of Germany

[21] Appl. No.: 10,577

[22] Filed: Jan. 28, 1993

[30] Foreign Application Priority Data

Feb. 5, 1992 [DE] Fed. Rep. of Germany ..... 4203148

[51] Int. Cl.[5] ..... B41F 21/00

[52] U.S. Cl. ..... 101/415.1; 101/378

[58] Field of Search ..... 101/378, 415.1, DIG. 36, 101/383, 384, 385

[56] References Cited

U.S. PATENT DOCUMENTS

| | | | |
|---|---|---|---|
| 3,125,023 | 3/1964 | Skinner et al. | 101/415.1 |
| 3,757,691 | 9/1973 | Etchell et al. | 101/378 |
| 4,527,478 | 7/1985 | Difflipp et al. | 101/415.1 |
| 4,854,237 | 8/1989 | Theilacker | 101/415.1 |
| 4,977,833 | 12/1990 | Inage et al. | 101/378 |
| 5,052,120 | 10/1991 | Lubberts | 101/415.1 |

FOREIGN PATENT DOCUMENTS

| | | |
|---|---|---|
| 0070378 | 5/1982 | European Pat. Off. . |
| 64725 | 7/1967 | Fed. Rep. of Germany . |
| 128886 | 12/1977 | Fed. Rep. of Germany . |
| 1187238 | 12/1967 | United Kingdom . |

*Primary Examiner*—Edgar S. Burr
*Assistant Examiner*—Ren Yan
*Attorney, Agent, or Firm*—Jones, Tullar & Cooper

[57] ABSTRACT

An inner blanket securement assembly utilizes spaced inner blanket engaging pins and an inner blanket hold-down device with a hook-shaped holding nose to secure an edge of an inner blanket to a cylinder. The inner blanket is structured using a plurality of inner layers within an outer casing that is closed and bag-shaped adjacent the leading edge of the inner blanket.

6 Claims, 2 Drawing Sheets

INNER BLANKET SECUREMENT ASSEMBLY

FIELD OF THE INVENTION

The present invention is directed generally to an inner blanket securement assembly. More particularly, the present invention is directed to an assembly for holding the inner layer of a two layer packing. Most specifically, the present invention is directed to an arrangement for holding the lower layer of a two-layer packing for an impression cylinder of a rotary press. The lower layer or inner blanket is structured as a multiple layer assembly having a plurality of interior layers placed within a surrounding bag. A plurality of holes are placed in this outer bag and these holes are placed over pins in the cylinder channel. An inner blanket hold down device that has a hook-shaped nose portion is placed on the channel wall between the spaced pins and receives the leading edge of the inner blanket intermediate the pins.

DESCRIPTION OF THE PRIOR ART

It is generally known in the art to arrange one or more inner layers or inner blankets beneath the usual blanket or printing blanket on an impression cylinder of a rotary printing press. The inner layer or layers may be one or more sheets of paper or may be an inner blanket. The thickness of the inner blanket and its composition can be varied in accordance with the type of printing that is being performed on the rotary press in which the impression cylinder is utilized. The use of inner layers or inner blankets of varying thicknesses allows the effective diameter of the cylinder to be varied in accordance with various printing technologies.

In the German Democratic Republic patent specification No. 128 886 there is shown a device that is usable to secure the lowest layer or layers of packings, when there are multiple layers, in transfer or offset cylinders. This is accomplished by placing the edge of the lower packing or inner blanket between a wall surface of the cylinder groove and a generally trapezoidally shaped bar which is positioned in the cylinder channel and which is spring biased toward the cooperatively inclined face of the cylinder channel. One limitation of this prior art device is that the trapezoidal bar has to be adjusted by hand by use of a wrench. In addition, the upper or outer blanket has to be passed through a slit or slot in the trapezoidal bar so that it can be placed in its tensioning shaft. This feeding of the leading edge of the outer blanket through the slot in the trapezoidal inner blanket securement bar is time consuming. The placement of this elongated slot in the trapezoidal bar also is apt to weaken the bar.

Another prior art inner blanket holding device, which is usable to hold the inner layer of a two layer packing on the periphery of an impression cylinder in a printing press is shown in European patent specification No. 0 070 378. In this device, the inner blanket or layer holding bar is generally circular in cross-section and is placed in the cylinder channel of the impression cylinder so that it will be able to receive the end of the inner layer or blanket. The ends of this holding bar are supported by pins that are received in holes in the bearer rings which are secured to the ends of the impression cylinder.

A limitation of this prior art device is that it is quite costly to manufacture. Further, special tools are required to actuate the holding bolts which are carried by this holding bar and which engage the inner blanket that is to be secured by this prior art holding bars. Also, this holding bar requires a relatively large amount of space in the cylinder channel. Another limitation of this prior art device is that the entire holding bar and all of the holding bolts have to be actuated jointly with all the adjustable holding elements when it is necessary to change or vary the thickness of the inner blanket due to printing changes.

This prior art holding bar is located between the bearer rings which are carried at the ends of the impression cylinder. This can lead to a loosening of the holding bar if the bearer rings should shift or move during a printing operation, for example with a reduction in the number of ink colors when the holding bar is held without a layer but is not engaged in the way that it should be. Finally, this prior art holding bar is intended for use with cylinders that have bearer rings. If the cylinder is without these rings, it is necessary to attach additional or auxiliary holding devices to the ends of the impression cylinder so that this prior art device can be used.

It will be apparent that a need exists for an inner blanket or lower layer holding device which overcomes the limitations of the prior art devices. The inner blanket securement assembly of the present invention provides such a device and is a significant improvement over the prior art devices.

SUMMARY OF THE INVENTION

It is an object of the present invention to provide an inner blanket securement assembly.

Another object of the present invention is to provide an assembly for holding the inner layer of a two layer packing.

A further object of the present invention is to provide an arrangement for holding the lower layer of a two layer packing for an impression cylinder of a rotary press.

Yet another object of the present invention is to provide an inner blanket securement assembly that utilizes spaced pins and an intermediate hold down device.

Still a further object of the present invention is to provide an inner blanket securement assembly for a multi-layer inner blanket having a bag-shaped outer portion.

As will be discussed in greater detail in the description of the preferred embodiment which is set forth subsequently, the inner blanket securement assembly in accordance with the present invention is usable to secure an inner layer or blanket of a multiple layer blanket assembly to an impression cylinder in a rotary printing press. The cylinder channel of the impression cylinder is provided with a tensioning shaft for the outer blanket and with a plurality of spaced pins along a front wall or leading face. These pins engage apertures in the edge of the inner blanket. A hold down device is placed between each two spaced pins. This hold down device has a hook-shaped holding nose that receives the edge of the inner blanket intermediate the pins. The inner blanket itself is preferably formed as a multiple layer assembly with an outer cover or casing that is generally bag-shaped at its end. The number of inner sheets or layers placed within this outer casing can be varied to change the thickness of the inner blanket. The inner layers that are insertable into the outer casing of the inner blanket can have tapered leading edges so that they can be placed in or removed from the outer casing without removing this casing from the inner blanket holding pins.

The inner blanket securement assembly of the present invention provides an arrangement for use with printing presses that does not require a great deal of space and which can easily and safely be used with a variety of inner layer thicknesses to hold the lower or inner layer of two-layer packings, even for impression cylinders without bearer rings. Since the lower or inner blanket is secured in place without the use of a holding bar, there is required only a small amount of space in the cylinder channel. The securement assembly of the present invention provides the necessary holding security while not requiring additional component parts. The inner blanket securement assembly of the present invention does not have to be removed or dismounted in case an inking or printing unit is not utilized.

The inner blanket securement assembly of the present invention overcomes the limitations of the prior art. It provides an assembly that is superior to the prior art devices and is a substantial advance in the art.

BRIEF DESCRIPTION OF THE DRAWINGS

While the novel features of the inner blanket securement assembly in accordance with the present invention are set forth with specificity in the appended claims, a full and complete understanding of the present invention may be had by referring to the detailed description of the preferred embodiment which is presented subsequently, and as illustrated in the accompanying drawings in which:

DESCRIPTION OF THE PREFERRED EMBODIMENT

Figure 1:
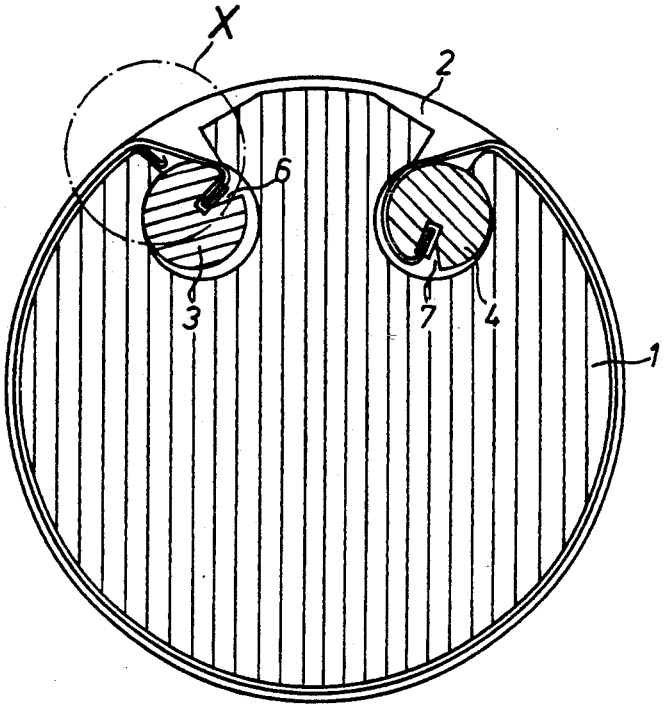
FIG. 1 is a cross-sectional view through an impression cylinder utilizing the inner blanket securement assembly in accordance with the present invention.
Figure 2:
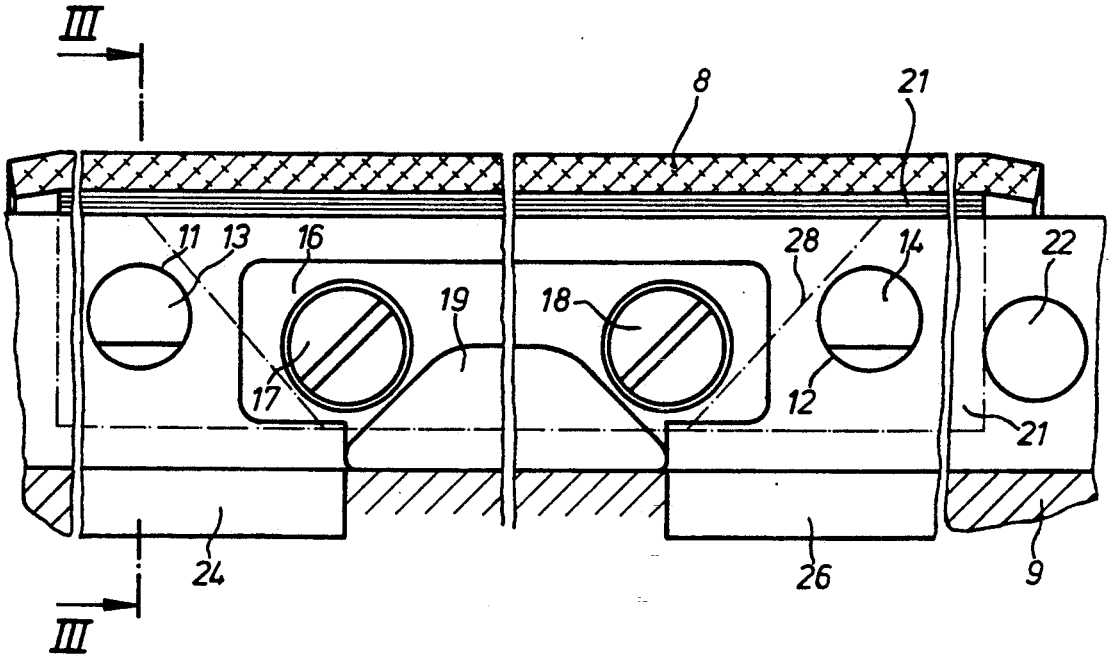
FIG. 2 is a front elevation view, partly in section of a cylinder channel provided with the securement assembly of the present invention and taken in the direction indicated by arrow A in FIG. 3.
Figure 3:
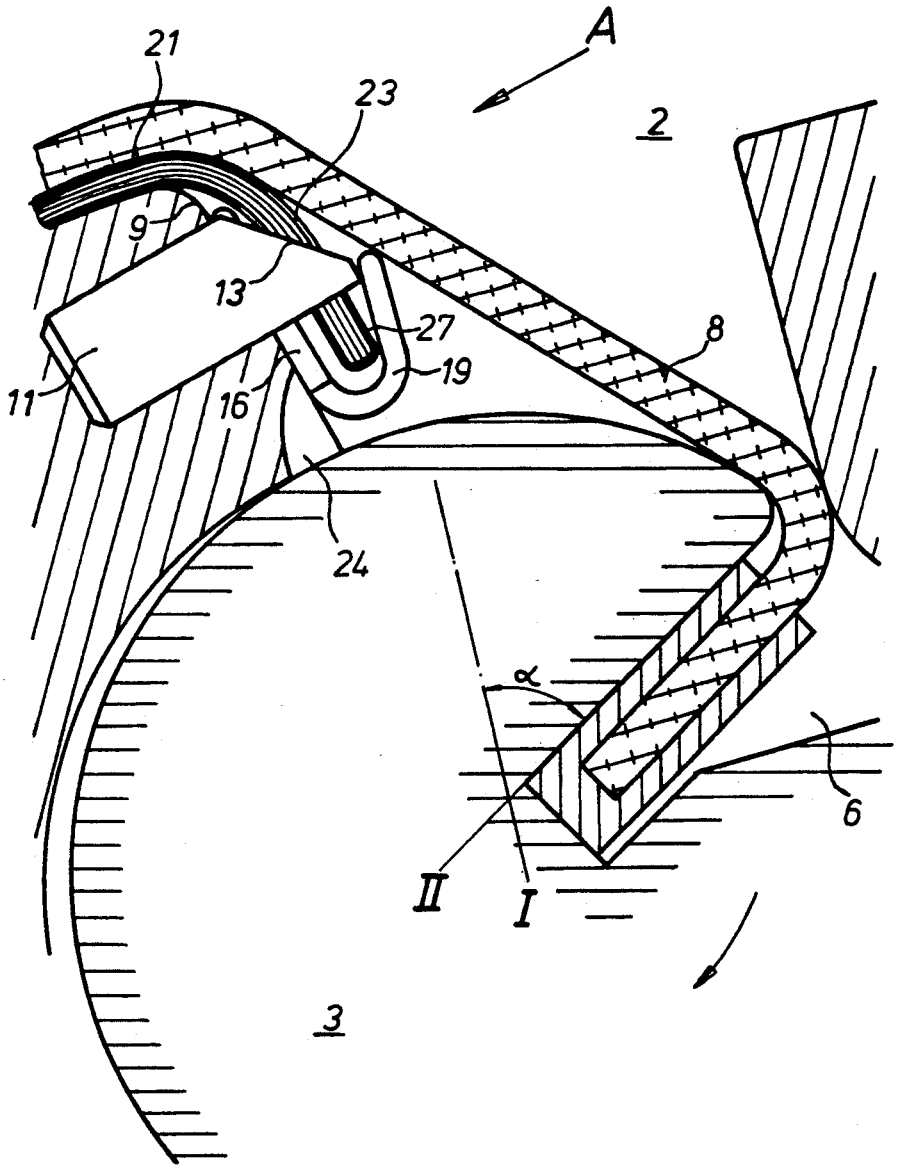
FIG. 3 is an enlarged cross-sectional view of the portion of the impression cylinder shown encircled at X in FIG. 1 and taken along line III—III of FIG. 2.

Referring initially to FIG. 1 there may be seen an impression cylinder, generally at 1 which is provided with the inner blanket securement assembly in accordance with the present invention. It will be understood that impression cylinder 1 is part of a rotary printing press or machine and that impression cylinder 1 is mounted for rotation in any suitable manner. Impression cylinder 1 is provided with spaced, axially extending cylinder channels, generally at 2, which extend along the peripheral surface of the impression cylinder 1 generally parallel to an axis of rotation of cylinder 1. These cylinder channels 2 receive tensioning shafts 3 and 4 that are used to receive and tighten the ends of an outer blanket, generally at 8, as seen in FIGS. 2 and 3, which is placed on the outer periphery of the impression cylinder 1 generally atop one or more inner blankets or packings, one of which is depicted generally at 21 in FIGS. 2 and 3. As may be seen most clearly in FIG. 3, each tensioning shaft 3 or 4 has a notch 6 or 7 which receives an end of the upper blanket 8. Each tensioning shaft 3 and 4 is generally conventional and can be rotated between the tensioned position indicated at II in FIG. 3 and through an angle $\alpha$ to the untensioned position indicated by the broken line I in FIG. 3. The means used to rotate and to lock the tensioning shafts 3 and 4 are generally known and form no part of the present invention.

Turning now primarily to FIGS. 2 and 3 a front wall surface 9 of the cylinder channel 2 is provided with a plurality of spaced pins 11 and 12. These pins are secured by suitable means, such as gluing or the like in suitable boreholes formed in the front face 9 of the cylinder channel 2. The pins extend generally perpendicularly out into the cylinder channel 2 from the generally radially extending front faces 9 of the channel 2. Projecting ends of the pins 11 and 12 are provided with chamfered faces 13 and 14. As may be seen most clearly in FIG. 3, these pins 11 and 12 are used to engage cooperatively positioned holes 23 adjacent a leading edge 27 of a lower layer or inner blanket 21 when the inner blanket 21 is placed on the impression cylinder beneath the outer blanket 8.

As may be seen most clearly in FIG. 2, an inner blanket leading edge hold down device, generally at 16 is secured by suitable countersunk screws 17 and 18 to the front wall or face 9 of the cylinder channel 2 between the spaced pins 11 and 12. This inner blanket hold-down device 16 has a generally hook-shaped holding nose 19 which forms a somewhat U-shaped channel which, as may be seen most clearly in FIG. 3, receives the leading edge 27 of the lower or inner layer or blanket 21 when this inner blanket 21 is placed on the impression cylinder 1 with its spaced holes 23 in engagement with the pins 11 and 12

Figure 4:
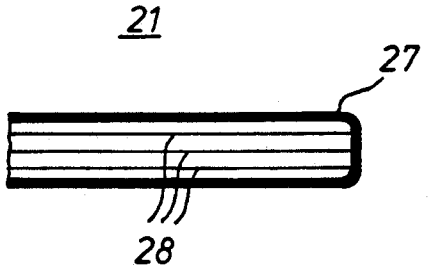
FIG. 4 is a schematic cross-sectional view of a leading edge portion of an inner blanket in accordance with the present invention.

The lower layer or inner blanket 21, which may consist of a plurality of individual sheets or inner layers 28, as seen in FIG. 4, is attached to the impression cylinder 2 by placement of the pins 11 and 12 through the spaced holes 23 in the blanket 21. A suitable lateral stop 22, as seen in FIG. 2, is used to align one side of the inner blanket 21. The middle portion of the leading edge 27 of the inner blanket 21 is held by the inner blanket hold-down device 16 beneath the hook-shaped holding nose 19. As was discussed previously, the outer blanket 8 can be removed by rotation of the tensioning shafts 3 and 4 to the rest positions indicated by line I in FIG. 3. Once the tensioning shafts 3 and 4 are untensioned, the outer blanket 8 can be removed to provide access to the inner blanket 21 which can then also be readily removed by disengagement of the holes 23 from the pins 11 and 12 and by removal of the middle of the inner blanket leading edge 27 from beneath the holding nose 19 of the inner blanket hold-down device 16. Spaced recesses 24 and 26 at the radially inner portion of the front wall 9 of the cylinder channel 2 facilitate the removal of the lower packing or inner blanket 21.

As is shown most specifically in FIG. 4, the lower packing or inner blanket 21 is preferably formed as a multi-layer assembly with a plurality of inner layers 28 being placed within an outer casing. This outer casing or outer layer of the inner blanket 21 is generally bag-shaped or closed at its leading edge 27. The outer casing has the pin engaging holes 23 formed in it. Depending on the type of printing to be accomplished, the inner blanket 21 can be made thicker or thinner by placement of more or fewer inner layers 28 in the outer casing. As is depicted by dashed lines in FIG. 2, the leading edges of the inner layers 28 which are insertable into the outer casing of the inner blanket 21 have tapered corners so that they will not engage the posts or pins 11 and 12 that are received in the holes 23 in the outer casing of the inner blanket 21. This allows the thickness of the inner blanket 21 to be varied by addition or removal of individual sheets 28 without removing the inner blanket 21 from the impression cylinder.

While a preferred embodiment of an inner blanket securement assembly in accordance with the present invention has been set forth fully and completely hereinabove, it will be apparent to one of skill in the art that a number of changes in, for example, the overall size of the impression cylinder, the means for rotatably supporting and driving the impression cylinder, the means for tensioning and releasing the tensioning shaft and the like may be made without departing from the true spirit and scope of the present invention which is accordingly to be limited only by the following claims.

What is claimed is:

1. An inner blanket securement assembly usable to secure an inner blanket of a multiple layer blanket arrangement to a cylinder, said inner blank securement assembly comprising:

a rotatable cylinder having a peripheral, axially extending cylinder channel;

a front wall surface in said cylinder channel;

a plurality of inner blanket leading edge securement pins spaced axially along said front wall surface and having leading edge portions extending into said cylinder channel from said front wall surface;

at least a first inner blanket hold-down device positioned on said front wall surface between spaced ones of said plurality of pins, said inner blanket hold-down device having a generally hook-shaped holding nose which forms a generally U-shaped channel that is sized to receive a portion of a leading edge of an inner blanket intermediate said securement pins; and spaced recesses at a radially inner portion of said front wall surface of said channel, said recesses facilitating removal of a leading edge of an inner blanket from said inner blanket securement assembly.

2. The inner blanket securement assembly of claim 1 wherein said securement pins have chamfered ends.

3. The inner blanket securement assembly of claim 1 further including an inner blanket having a leading edge, said leading edge having spaced pin receiving holes for receipt of said securement pins.

4. The inner blanket securement assembly of claim 3 wherein said inner blanket has a plurality of inner layers and an outer casing with a bay-shaped leading edge.

5. The inner blanket securement assembly of claim 4 wherein said plurality of inner layers have generally tapered leading edge portions.

6. The inner blanket securement assembly of claim 3 further including a lateral stop pin positioned at one side of said front wall, a side edge of said inner blanket being engageable with said stop pin.

* * * * *